United States Patent [19]

Prior et al.

[11] Patent Number: 4,670,115

[45] Date of Patent: Jun. 2, 1987

[54] ELECTROLYTIC SILVER REFINING PROCESS AND APPARATUS

[75] Inventors: Adalbert Prior, Vienna; Rolf Marr; Hans J. Bart, both of Styria, all of Austria

[73] Assignee: Ogussa Osterreichische Gold-und-Silber-Scheidean stalt Scheid und Roessler Gesellschaft m.b.H. & Co. KG, Austria

[21] Appl. No.: 642,986

[22] Filed: Aug. 22, 1984

[30] Foreign Application Priority Data

Aug. 29, 1984 [AT] Austria ..... 3073/83

[51] Int. Cl.[4] ..... C25C 1/20

[52] U.S. Cl. ..... 204/109; 204/106; 204/130; 204/111; 204/252; 204/263; 75/101 BE; 208/308

[58] Field of Search ..... 204/106, 108, 130, 109, 204/111, 252, 263; 75/101 BE; 208/308

[56] References Cited

U.S. PATENT DOCUMENTS

| | | | |
|---|---|---|---|
| 3,224,873 | 12/1965 | Swanson | 75/101 BE |
| 3,410,794 | 11/1968 | Li | 208/308 |
| 3,975,244 | 8/1976 | Hunter | 204/109 |
| 4,374,713 | 2/1983 | Natansohn et al. | 204/109 |
| 4,443,305 | 4/1984 | Haynes | 204/111 |
| 4,468,303 | 8/1984 | Griffin et al. | 204/110 |

FOREIGN PATENT DOCUMENTS

| | | | |
|---|---|---|---|
| 614238 | 11/1979 | Switzerland | 204/109 |

OTHER PUBLICATIONS

"Liquid-Membrane-Permeation, A Hydrometallurgical Process", leaflet (no other information available).

Li and Schrier, "Liquid Membrane Water Treating," Recent Developments in Separation Science, 1972, pp. 163–174.

Draxler and Marr, "Emulsion Liquid Membranes," pp. 1–29 and Figures.

*Primary Examiner*—R. L. Andrews

*Attorney, Agent, or Firm*—Seidel, Gonda, Goldhammer & Abbott

[57] ABSTRACT

In an electrolytic silver refining process, crude silver is anodically dissolved while refined silver is cathodically deposited and at the accompanying (impurity) metals are selectively extracted from the used (spent) electrolyte and transferred to an aqueous phase. The used electrolyte is enriched in silver and accompanying metals are cathodically deposited and thus removed from the electrolyte. For this purpose, a specific electrolysis cell is provided. The cell being preferably a diaphragm cell with an anionic diaphragm. The extraction of the accompanying metals is achieved by liquid membrane permeation, preferably combined with solvent extraction.

21 Claims, 3 Drawing Figures

ELECTROLYTIC SILVER REFINING PROCESS AND APPARATUS

Figure 1:
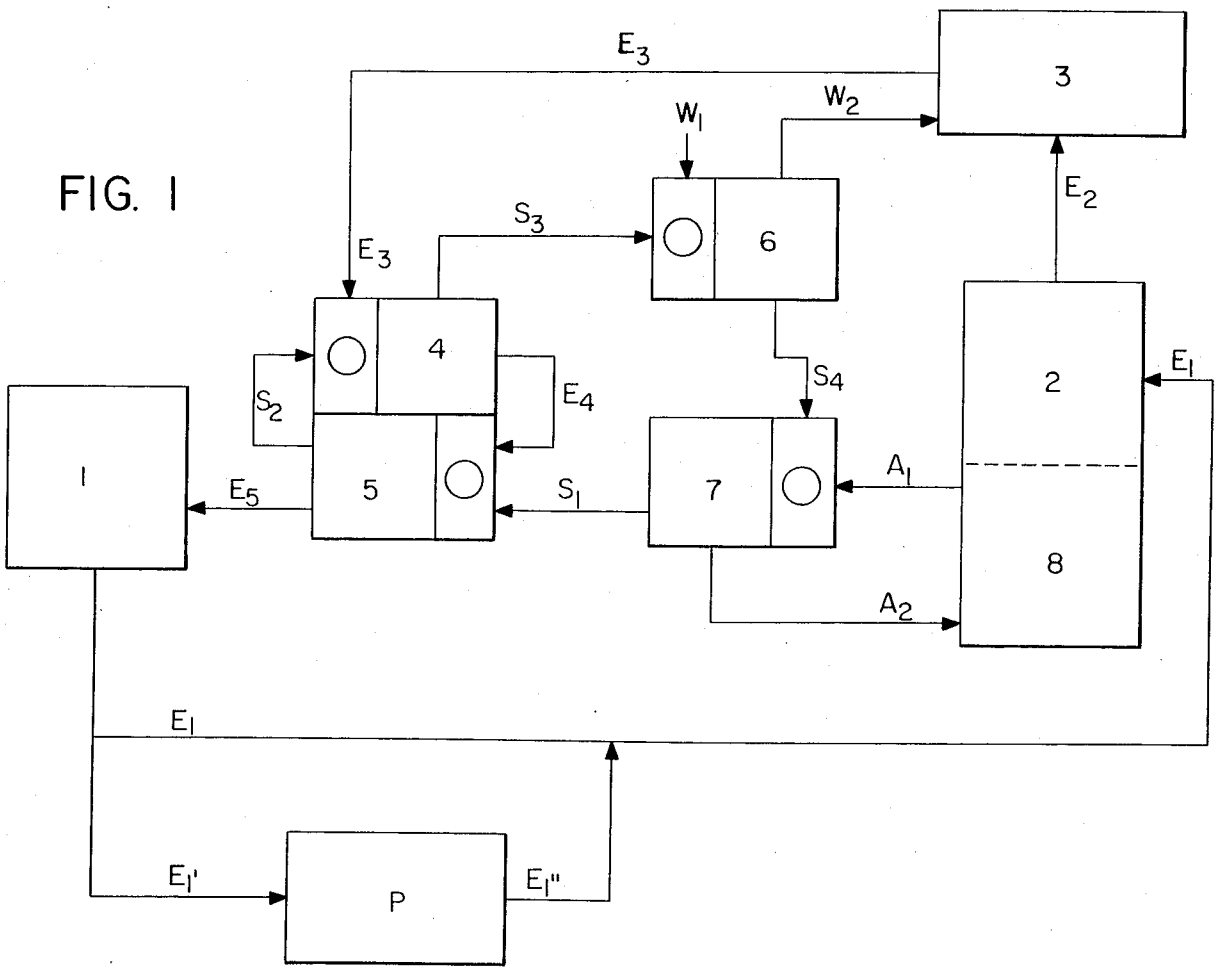

The present invention is directed to a process for decontaminating and enriching a used electrolyte from a silver refining process. Specifically, this is a process in which the used electrolyte is anodically enriched in silver and contaminating metals are cathodically deposited therefrom. The used electrolyte is enriched in silver by the anodic dissolution of a crude silver anode. The contaminating metals are selectively extracted from the used electrolyte, transferred to an aqueous phase and cathodically deposited. The regenerated electrolyte, having been stripped of accompanying metals and enriched in silver, is returned to the silver refining electrolysis cell.

Electrolytic silver refining is normally carried out according to the Moebius or Balbach/Thum process. The common contaminating metals, in particular copper, are an essential impediment to the refining process. These contaminating metals are dissolved and enrich the electrolyte. In typical silver nitrate baths, a Cu-content of about 60 g/l is considered to be the maximum permissible value. In excess of this value, cathodic deposition of copper may occur and Cu salts are trapped in the refined silver so that the purity requirements are no longer met. Therefore, the used electrolyte must be regenerated and exchanged from time to time.

In the past, silver refining has been performed by electrolyte recycling. The electrolyte recycling, i.e., removal of contaminating metals, was accomplished by solvent extraction techniques. The used electrolyte was withdrawn from the refining cell. Copper was extracted from the used electrolyte and the resulting regenerated electrolyte, having only a small copper content, was returned to the refining cell. The extracted copper was transferred to an aqueous phase and was separately deposited cathodically. A large number of organic reactants are known as selective extractants for Cu. Such extractants are chelate forming agents, such as phenoneoximes or quinolines. The contaminating metal in the used electrolyte is extracted in mixer/settler devices and the Cu is stripped from the organic extraction phase by means of an acid stripping solution. The Cu or other contaminating metals of the enriched stripping solution are electrolyzed. Then, Cu and possibly Ni may be cathodically deposited. Depending on the chelate forming agent and the operating conditions, it is possible to extract contaminating metals more or less selectively. The organic phase (solvent plus extractant) is washed. The organic phase, and the stripping solution are regenerated by means of electrolysis and the regenerated electrolyte are recycled. See Swiss Patent Specification No. 614,238.

In silver refining electrolysis, it is necessary that the electrolyte has silver ions in solution. Due to the simultaneous dissolution of Cu and Ag at the anode of the refining cell, more Ag is deposited at the cathode and removed from the electrolyte than is dissolved at the anode. As a result, the electrolyte becomes deficient in silver. To compensate for the depletion of Ag in the electrolyte, pure silver nitrate (in solution form) must be added to the regenerated electrolyte. This is a handicap for the process, as pure silver nitrate is an expensive product.

Thus, the problem was to provide a process in which a complete continuous regeneration of the electrolyte is effected without having to compensate for the deficiency in silver by adding silver nitrate.

The problem is solved, according to the invention, by providing a common electrolysis operation in which the used electrolyte, i.e., from the refining cell, is anodically enriched in silver and contaminating metals are cathodically deposited from the aqueous phase, the extraction steps(s) optionally being performed by liquid membrane permeation, or preferably a combination of solvent extraction and liquid membrane permeation.

The device for carrying out the process according to the invention is generally provided with: at least one refining cell; at least one extraction means for extracting the contaminating metals from the used electrolyte and to transfer the extracted contaminating metals to an aqueous phase; and at least one common electrolysis cell for enrichment of the used electrolyte in silver and for cathode deposition of the contaminating metals. The common electrolysis cell is preferably in the form of a diaphragm cell with an anodic diaphragm (i.e. anionic permselective membrane).

The purpose of the anionic permselective membrane is (1) to prevent silver from wandering into the cathode zone where it would be deposited with the contaminating metals and (2) to maintain the intended strong concentration gradient in nitrate ions between cathode zone and anode zone.

In the common electrolysis cell, Ag is anodically dissolved. Preferably a crude silver anode is used in the common electrolysis cell, as the content in contaminating metals does not have to be completely eliminated, but instead merely needs to be reduced. The current liberated on the cathode during cathodic deposition of the contaminating metals supports the dissolution of the silver anode.

It was found that the suggestion made in the Swiss patent to re-extract the organic extract phase enriched in contaminating metals by means of a sulphuric acid stripping solution is technologically unfavorable. The stripped organic phase of solvent/extractant will have to be washed free of sulfate ions prior to returning to the extraction step, so as to prevent contamination of the refining electrolyte (nitric acid solution).

According to the invention, the process is preferably carried out exclusively by means of solutions of ion parity. In particular, nitric acid solutions are used exclusively. Thus, the problem encountered in the Swiss patent does not arise and the operation of the common electrolysis cell for the anodic deposition of contaminating metals and for anionic silver enrichment can be performed trouble free.

By suitable selection of the extractants for the contaminating metals, it is possible to prevent the coextraction of silver to the extent that it becomes possible to carry out the electrolytic silver enrichment of the used electrolyte prior to the extraction of the contaminating metals. Chelate forming agents have been proven to be the most selective extractants.

In the process according to the invention, the extraction of the contaminating metals is normally carried out using solvent extraction techniques. The used electrolyte is first treated in a solvent/extractant phase and is subsequently stripped by means of a stripping solution of ion parity ($NO_3^-$).

It was found, however, that advantages can be obtained with respect to the extraction of contaminating metals other than Cu, of which particular mention should be made of platinum metals such as Pb, Pd, or Pt, Ni, W, Zn and Cd. These advantages are obtained if the extraction process is carried out by means of liquid membrane permeation. It is also possible to obtain these advantages by applying a combination of solvent extraction and liquid membrane permeation techniques.

In the latter procedure, the solvent/extractant phase serves as a separating membrane between the used refining electrolyte and the acidic stripping solution which is emulsified in the separating membrane. After the transition (permeation) of the contaminating metal(s) from the used electrolyte into the organic emulsifying phase, the emulsion phase is separated and disintegrated in a manner know per se into an aqueous phase (enriched stripping solution) and an organic phase (solvent/extractant). The enriched stripping solution is regenerated again by means of subsequent contaminating metal electrolysis or separation of valuable substance without electrolysis and emulsified again in the organic phase. The organic phase merely serves as a selective separating medium between the aqueous phases (used refining electrolyte and stripping solution) so that in contrast to liquid/liquid extraction, it does not have to take up the contaminating metal. This brings about an essentially decreased solvent requirement and high enrichment rates, for instance in the range of 1:100.

Figure 2:
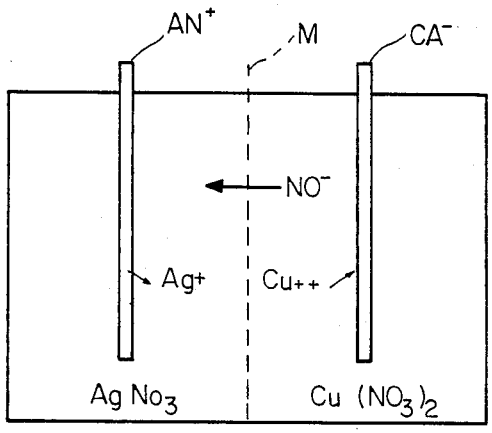
Figure 3:
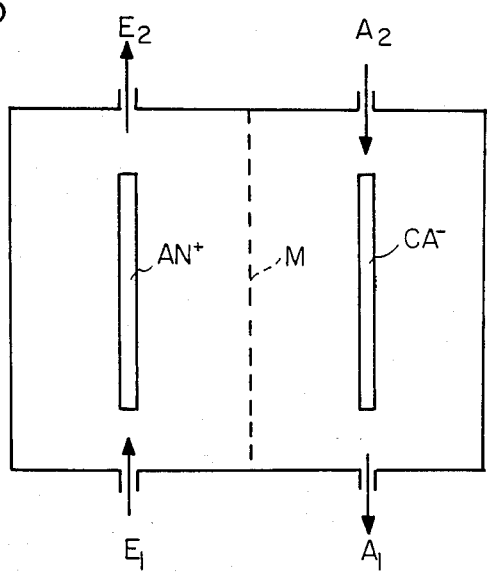

The invention is explained in detail by means of examples with reference to the accompanying drawing in which FIG. 1 shows a flow chart of an apparatus according to the invention for carrying out the invention, FIG. 2 being a sectional side view of a diaphragm cell and FIG. 3 a respective plan view.

The used electrolyte $E_1$ flows from the refining cell 1 into the anode 3 zone 2 of an electrolytic diaphragm cell 2, 8, where $E_1$ is enriched in silver by anodic dissolution of a silver anode. The electrolyte $E_3$ (enriched in silver) is then conveyed into the collecting tank 3 where its pH-value is adjusted by addition of a base or the like to a value suitable for contaminating metal extraction by passing $E_2$ over Cu/Ag scrap. An electrolyte $E_3$ of adjusted pH-value is then conveyed to a two-step extraction device 4, 5, for instance a mixer/settler device. In device 4, 5, $E_3$ is extracted in counter-current fashion by means of a regenerated solvent/extractant phase S, (called solvent phase for short). The pH-adjusted electrolyte $E_3$ flows into the mixer of first extraction unit 4, contaminating metals are extracted by means of a solvent phase $S_2$, which was already enriched in a second extraction unit 5. A preextracted electrolyte $E_4$ is conveyed from the settler of the first extraction unit 4 into the mixer of the second extraction unit 5 where contaminating metal is further extracted by means of the regenerated solvent phase $S_1$.

From the settler of the second extraction unit 5, the now regenerated electrolyte $E_5$ is recycled to the refining cell.

The solvent phase $S_3$ doubly enriched in contaminating metal is conveyed from the settler of the first extraction unit 4 to the mixer of a scrubbing device 6 wherein the silver content is reduced by washing with a copper-containing washing solution $W_1$. In this step, the silver in the solvent phase $S_3$ is displaced by copper and the silver-enriched washing solution $W_2$ is returned to the collecting tank 3. The provision of a scrubbing device 6 is not absolutely necessary.

From the settler of the scrubbing device 6, a solvent phase $S_4$ deficient in silver is conveyed into the mixer of a stripping device 7 where the contaminating metal is removed by re-extraction using a regenerated acidic stripping solution $A_1$ or the contaminating metal content is reduced to a desired degree. From the settler of the stripping device 7, the now regenerated solvent phase $S_1$ is recycled to the mixer of the second extraction unit 5.

The stripping solution $A_2$ enriched in contaminating metal is conveyed from the settler of the stripping device 7 into the cathode zone 8 of the diaphragm electrolysis cell 2, 8 where contaminating metal is cathodically deposited. The stripping solution $A_1$, thus regenerated, is recycled to the mixer of the stripping device 7.

It should be noted that in the process according to the invention, an electrolytic enrichment of the used electrolyte in silver and a cathodic deposition of the extracted contaminating metal (in particular copper) are carried out simultaneously in a common electrolysis cell 2, 8.

Moreover, a closed cycle for the electrolyte, solvent phase and stripping solution is possible. The sequence of the process steps can be so selected that the used electrolyte is enriched in silver by anodic dissolution of a silver electrode subsequent to the extraction of contaminating metal. In this, the used electrolyte $E_1$ is first conveyed to the extraction units 4, 5 and from there flows into the anode zone 2 of the diaphragm electrolysis cell, where it is enriched in silver and then recycled to the electrolysis cell 1. The cycle of the solvent phase and stripping phase remains unchanged. This sequence of steps offers a further advantage that not so much Ag is carried over into the extract $S_3$.

If Cu and, for instance, W (tungsten) are to be separated in the process according to the invention, a partial stream $E_1'$ of the used refining electrolyte $E_1$ can be branched off and conveyed to a permeator P prior to its introduction into the anode zone 2 of the diaphragm electrolysis cell 2, 8. In the permeator P, the partial stream $E_1$ is freed of W, or its W-content reduced as desired, by selective transfer using an emulsion of a sripping solution in an organic solvent/complexing agent phase. The electrolyte $E_1'$ now stripped of W is recycled to the electrolyte stream $E_1$. Similar arrangements can be made in respect of the other contaminating metals. In principle, extraction of permeation steps for the selective separation of various contaminating metals can be arranged in series, with or without operation with partial streams. The processing of the stripping solutions enriched in contaminating metals for recovery of valuable substances can be effected by means of electrolysis, according to other known processing methods or a combination of the processes indicated.

FIGS. 2 and 3 schematically show the diaphragm cell with its anionic membrane M, its copper cathode CA and its crude silver anode AN, the electrolytes, the reactions within said cell and the flowing path of electrolyte E and stripping solution A.

The following examples refer to the way of proceeding and the apparatus described above.

EXAMPLE 1

From the anode zone 2 of the diaphragm cell 2, 8, a used electrolyte $E_2$ enriched in Ag and containing 37.7 g/l of Cu and 67 g/l of Ag is conveyed to the storage tank 3. The used electrolyte $E_2$ is withdrawn from the storage tank 3 at a rate of 1 l/h and extracted in the two extraction units 4, 5 by means of an extractant $S_1$, added at a rate of 2 l/h, consisting of 20 parts by volume of Acorga PT 5050 (Acorga Ltd.) as a complexing agent and 80 parts by volume of Shellsol AB (aromatic solvent by Shell Intern.) as a diluent. The complexing agent Acorga PT 5050 is a mixture of 2 parts of 2-hydroxy-5-nonyl-benzaldoxime and 1 part tridecanol. The organic extract $S_3$ contains 10.4 g/l of Cu and 10 ppm of Ag and is either directly regenerated in the stripper 7 by means of an aqueous stripping solution $A_1$ (30 g/l Cu, 2 mol/l $HNO_3$, 1 1/h) or wholly or partially stripping of Ag in the scrubber 6 by means of an aqueous solution of 1 mol/l $Cu(NO_3)_2$ prior to this. The enriched stripping solution $A_2$ contains 59.5 g/l of Cu, the regenerated extractant $S_1$ contains 3.2 g/l of Cu. In the diaphragm cell 2, 8, 7.2 g/h of Cu are cathodically deposited, the equivalent amount of silver being anodically dissolved. The used scrubbing solution $W_2$, as shown in FIG. 1, is returned to the storage tank 3. The electrolyte $E_5$ stripped of Cu is recycled to the refining cell 1 (Moebius).

EXAMPLE 2

The operation was identical to that of Example 1, with the exception that the extractant $S_1$ consisted of 20 parts by volume of SME 529 (2-hydroxy-5-nonylacetophenoxime) as a complexing agent and 80 parts by volume of MSB 529 (aromatic solvent by Shell Itern.) as a diluent. The extract $S_3$ contained 7.6 g/l of Cu and 750 ppm of Ag and was washed in the scrubber 6 by means of an aqueous solution of 1.0 m Cu $(NO_3)_2$. The extract $S_4$ stripped of Ag (12 g/l Cu, 2 mol/l $HNO_3$, 1 l/h) was treated in the stripper by means of an aqueous stripping solution $A_1$ (30 g/l Cu, 2 mol/l $HNO_3$, 1 l/h). The regenerated extractant $S_1$ contained 1.9 g/l of Cu, the enriched stripping solution $A_2$ was conveyed to the cathode zone 8 of the diaphragm cell 2, 8 where 20.2 g/l of Cu were deposited and the equivalent amount of Ag was dissolved anodically.

EXAMPLE 3

It was operated as described in Example 1, with the exception that the extractant $S_1$ consisted of 20 parts by volume of HS-LIX 64 as a complexing agent and 80 parts by volume of MSB 529 (aromatic solvent by Shell Itern.) as a diluent. The complexing agent HS-LIX 64 contains as active ingredients 20 parts of 3-hydroxy-5-nonylbenzophenoneoxime and 1 part 5, 8-diethyl-7-hydroxy-6-dodecanoneoxime. The extract $S_3$ contained 6.9 g/l of Cu and 1.5 g/l of Ag and was washed in the scrubber 6 by means of an aqueous solution of 2 mol/l of Cu $(NO_3)_2$ to a content of 10.5 g/l of Cu and 230 ppm of Ag. The washed extract $S_4$ was then stripped in the stripper 7 in a phase ratio of extract $S_4$ to stripping solution $A_1$ of 2:1 by means of an aqueous stripping solution containing 30 g/l of Cu and 2 mol/l of $HNO_3$. From the enriched stripping solution $A_2$, 19.2 g/l of Cu were deposited in the cathode zone 8 of the diaphragm cell 2,8, while the equivalent amount of Ag was dissolved in the anode zone.

EXAMPLE 4

An electrolyte $E_2$ containing 90 g/l Ag, 30 g/l Cu, 5 g/l Ni, 0.6 g/l Cd, 0.4 g/l W, 0.25 Pd and 0.05 g/l Pt was withdrawn from the anode zone 2 of the diaphragm cell 2,8 and treated further as described in Example 1, with the exception that the complexing agent used in the extractant $S_1$, Acorga PT 5050, was not diluted by means of Shellsol AB, but instead by means of shell MSB 210 (mainly aliphatic solvent by Shell Itern.). The extract contained 11.0 g/l of Cu, 2 ppm of Ag and 300 ppm of Pd and was stripped in the stripper 7 by means of an aqueous stripping solution $A_1$ (35 g/l Cu, 2 mol/l $HNO_3$).

The regenerated extract $S_1$ contained 3.2 g/l of Cu and 300 ppm of Pd and was not wholly recycled to the extraction unit 5, but instead a partial stream in an amount of one tenth of its volume was branched off and extracted in a separate extraction unit by means of the same volume of 6 n HCL and so completely stripped of Cu and Pd. After subsequent washing with water for removal of the chlorine ions, the regenerated partial stream was added to the extractant $S_1$ again. Pd was precipitated from the hydrochloric acid stripping solution as Pd $(NH_3)_2Cl_2$.

EXAMPLE 5

A used Moebius cell electrolyte was stripped of copper in the apparatus described in the preceding Examples 1 to 4, with the enrichment in Ag in the anode zone 2 of the diaphragm cell 2,8 provided as the last regeneration step and a partial stream being withdrawn and further treated as follows prior to its entry into the anode zone 2:

(a) The electrolyte was stripped of Cu by usual metal salt extraction, of Ag by precipitation (AgCl) and subsequently contained 5 g/l of Ni and 0.6 g/l of Cd. The electrolyte was then extracted in an identical volume of an extractant consisting of 20 parts by volume of bis-2-ethyl-hexylthiophosphoric acid and 5 parts by volume of tributyl phosphate as a complexing agent and 75 parts by volume of Shellsol T (aliphatic solvent by Shell Itern.) as a diluent; Ni and Cd went into the extract and the aqueous raffinate was returned to the main stream of the electrolyte for anodic enrichment in Ag.

The extract was stripped first by means of 1 m $HNO_3$ and then by means of 2.5 n $HNO_3$; the extractant subsequently still contained 30 ppm of Cd.

The first stripping solution contained Ni exclusively, the second stripping solution contained Cd and Ni in a ration of Cd/Ni of 20:1. The stripping solutions were processed in the usual manner.

(b) The electrolyte was stripped of Cu and Ag as described in Example 5*a;* Pd was removed as $Pd(NH_3)_2Cl_2$. The electrolyte subsequently contained 50 ppm of Pt and was extracted at room temperature by means of the same volume of an extractant consisting of 30 parts by volume of trioctyl phosphine oxide as a complexing agent in 70 parts by volume of Shellsol T (aliphatic solvent by Shell Itern.) as a diluent; the extractant obtained contained 45 ppm of Pt. The aqueous raffinate containing 4 ppm of Pt was recycled to the main stream of the electrolyte for anodic enrichment in Ag.

The extract was extracted in an extraction column by means of half the volume of water at a temperature of 80° C.; 3 ppm of Pt remained in the extract and the water phase containing 91 ppm of Pt in the form of nitrate was processed in the usual way.

(c) The electrolyte was stripped of Cu, Ag and Pd as described in Example 5*b*. The electrolyte subsequently contained 0.5 g/l of W (tungsten) and was subjected to liquid membrane permeation. For forming the liquid membrane, a solvent/extractant phase containing analiphatic solvent, 5 percent M tertiary amine, namely Alamin 336 or Hostarex 327, as a complexing agent and 3 percent M ECA 4360 (tenside by Esso) in a volume ration of 2:1 was emulsified with an aqueous stripping solution consisting of saturated ammonium nitrate. Alamin 336 is a mixture of tertiary n-alkyl amines with $C_8$–$C_{10}$ alkyl chains, $C_8$-chains being predominant. Hostarex 327 (Hoechst) is a 1:1 mixture of tri-n-octylamine and tri-n-decylamine.

At a permeator throughput of 100 l/h of electrolyte and 3 l/h of the above-mentioned emlusion, a content in W of 49 g/l was obtained in the aqueous stripping phase after breaking down the emulsion. The electrolyte, which showed a residual content in W of 10 ppm, was returned to the main stream of the electrolyte for the purpose of enrichment in Ag. The solution enriched in W as processed in the usual way. In this, for instance, ammonium tungstate is crystallized and thermally decomposed and the tungsten oxide thus obtained is reduced to metallic W. It is also possible to obtain ammoniumtungstate as such.

EXAMPLE 6

A used Moebius electrolyte was regenerated in an apparatus as previously described in which the extraction unit 4, 5 is formed as a conventional liquid membrane permeator unit. For forming a liquid membrane, an extractant phase containing kerosene as a solvent, 3 percent by volume of Acorga P 1500 (1 part 2-hydroxy-5-nonylbenzaldoxime plue 1 part nonylphenol) as a complexing agent and 3 percent ECA 4360 (tenside on polyamine basis) was emulsified at a volume ration of 2:1 with an aqueous stripping solution containing 30 g/l of Cu and 2 mol/l of $HNO_3$.

The permeator operated at a throughput of 10 l/h of used electrolyte $E_2$ enriched in Ag or used electrolyte $E_1$ and 3 l/h of liquid membrane. In both cases, a Cu-content of about 60 g/l was obtained in the aqueous stripping solution obtained after breaking down the emulsion. Further processing can be effected in analogy to Examples 1 to 6.

In the Examples 1 to 6, a diaphragm cell provided with an anion exchange membrane on plastics material base with the trade name MA 3148 made by IONAC Chemical Co., New Jersey was used.

The process according to the invention offers the following advantages:

1. The cost of perparing large amounts of silver nitrate solution from purified water and silver nitrate is eliminated.

2. The cost of disposing of the contaminated electrolyte is eliminated.

3. Copper is recovered in a form particularly well suited for further processing.

4. Processing of silver precipitates or cemented silver is avoided.

5. The refining cell can be operated at optimum copper content, so that silver of the highest degree of purity can be recovered.

6. Accompanying metals, in particular copper, can be removed from the silver electrolyte as needed in larger amounts and at higher rates, so that highly contaminated starting material without preceding purification steps can be used. Anodes of silver contents of less than 95 percent can be dissolved in the diaphragm cell, while copper can be cathodically recovered simultaneously.

7. The aqueous electrolyte is a preferably nitric acid solution of ion parity. There is no contamination by foreign ions such as sulfate or chloride.

We claim:

1. A process for regenerating a used electrolyte from a Moebius or Balbach/Thum silver refining process comprising:

(a) removing a used electrolyte from a silver refining process;

(b) extracting contaminating metals from the used electrolyte;

(c) anodically dissolving silver in the used electrolyte; and (d) cathodically depositing the extracted contaminating metals.

2. The process according to claim 1 wherein extracting is performed by liquid membrane permeation.

3. The process according to claim 1 wherein extracting is performed by liquid membrane permeation in combination with solvent extraction.

4. The process according to claim 2 wherein dissolving and depositing are carried out in solution in which the concentration of ions on each side of the membrane is the same.

5. The process according to claim 1 wherein dissolving and depositing are carried out in a nitric acid solution.

6. The process according to claim 1 wherein at least one of the contaminating metals is copper.

7. The process according to claim 1 further comprising the step of:

substantially removing contaminating metals selected from the group consisting of Pb, Pd, Pt, Ni, W, Zn and Cd from the used electrolyte prior to steps (b)–(d).

8. The process according to claim 7 wherein removing is accomplished by liquid membrane permeation.

9. The process according to claim 1 wherein extracting contaminating metals is performed prior to cathodically depositing.

10. The process according to claim 1 wherein extracting contaminating metals is performed prior to anodically dissolving.

11. The process according to claim 1 further comprising the step of:

returning a regenerated electrolyte to the refining process and after steps (a)–(d) are performed.

12. A process for regenerating a used electrolyte from a Moebius or Balbach/Thum silver refining process comprising:

(a) removing a used electrolyte from a silver refining process;

(b) extracting contaminating metals from the used electrolyte;

(c) anodically dissolving silver in the used electrolyte; and (d) cathodically depositing the extracted contaminating metals, wherein (c) and (d) are performed simultaneously.

13. The process according to claim 12 wherein the contaminating metal is copper.

14. The process according to claim 13 wherein copper is first extracted from the used electrolyte and anodically dissolving is performed prior to returning a regenerated electrolyte to the refining process.

15. The process according to claim 13 further comprising the step of:

extracting second contaminating metals selected from a group consisting of Pb, Pd, Pt, Ni, W, Zn and Cd before anodically dissolving.

16. A process for regenerating a used electrolyte from a Moebius or Balbach/Thum silver refining process comprising:

(a) removing a used electrolyte from a silver refining process, said used electrolyte including first and second contaminating metals;

(b) extracting the second contaminating metals from the used electrolyte using a liquid membrane permeation procedure;

(c) aniodically dissolving silver into the used electrolyte, where a silver content of the used electrolyte is increased;

(d) extracting the first contaminating metal from the used electrolyte by liquid membrane permeation or a combination of solvent extraction and liquid membrane permeation, and forming an extract;

(e) stripping the extract of the first contaminating metal; and (f) cathodically depositing the stripped first contaminating metal.

17. An apparatus for Moebius or Balbach/Thum regeneration of a used electrolyte from a silver refining cell comprising:

an electrolysis cell in communication with the refining cell, said electrolysis cell including an anodic zone and a cathodic zone, whereby a silver content of the used electrolyte is increased in said anodic zone;

means for extracting contaminating metals from the used electrolyte being in communication with said refining cell;

means for transferring extracted contaminating metals into an aqueous phase being in communication with said cathodic zone of said electrolysis cell, whereby stripped contaminating metals in said aqueous phase are cathodically deposited in said cathodic zone.

18. The apparatus according to claim 17 wherein said electrolysis cell is a diaphragm cell.

19. The apparatus according to claim 18 wherein said diaphragm cell includes an anionic permselective membrane.

20. The apparatus according to claim 17 wherein said anionic zone includes an anode made of unrefined silver.

21. The apparatus according to claim 17 wherein said extracting means is means for liquid membrane permeation.

* * * * *